US006695139B2

(12) United States Patent
Lin

(10) Patent No.: US 6,695,139 B2
(45) Date of Patent: Feb. 24, 2004

(54) COSMETIC POWDER CASE

(76) Inventor: Yi-Hung Lin, No. 101, Shie-Jou Road, Yi-Shih Li, Tai-Ping City, Taichung Hsien (TW)

( * ) Notice: Subject to any disclaimer, the term of this patent is extended or adjusted under 35 U.S.C. 154(b) by 0 days.

(21) Appl. No.: 10/076,548

(22) Filed: Feb. 19, 2002

(65) Prior Publication Data

US 2003/0154997 A1 Aug. 21, 2003

(51) Int. Cl.[7] ..... C07B 305/10
(52) U.S. Cl. ..... 206/307
(58) Field of Search ..... 132/307, 305, 132/306, 300, 294, 293; 206/823, 581, 235; D28/82, 78

(56) References Cited

U.S. PATENT DOCUMENTS 1,670,315 A * 5/1928 Reutter ..... 132/305
1,687,451 A * 10/1928 Hoellrigl ..... 132/307
1,743,120 A * 1/1930 Deman ..... 132/305
2,488,850 A * 11/1949 Conner et al. ..... 132/306
5,025,817 A * 6/1991 Wen ..... 132/296
5,836,319 A * 11/1998 Lombardi ..... 132/287

* cited by examiner

*Primary Examiner*—John J. Wilson
*Assistant Examiner*—Robyn Kieu Doan
(74) *Attorney, Agent, or Firm*—Alan D. Kamrath; Rider Bennett, LLP.

(57) ABSTRACT

A cosmetic powder case includes a case body having a lip wall. The lip wall has a position slot at interior side thereof and an order slot at exterior side thereof. The order slot has a locking slot thereon. A separate disk has an axial hole at central, channel portions around the axial hole, and a lock sidewall at the edge thereof which has position flange at exterior side thereof and a ring slot at interior side thereof. The ring slot has position blocks therein. A rotatable disk has an axial rod at bottom side thereof, channels located around the axial rod, and an L-shaped lock flange extended from the edge thereof. The lock flange has a ring rib at distal end of interior side thereof, and a puff has a band thereon for facilitating user to grip.

4 Claims, 13 Drawing Sheets

COSMETIC POWDER CASE

FIELD OF THE INVENTION

The present invention related to a container, and more particularly to a cosmetic powder case.

BACKGROUND OF THE INVENTION

FIG. 1 shows a conventional cosmetic powder case, which has a case body 1, a cover 2, a separate disk 3 and a puff 4. The case body 1 is to receive cosmetic powder (not shown) therein. The separate disk 4 has openings 4*a* thereon. The puff 4 has a band 4*a* for facilitating user to grip. To assemble the case, first fill the case body 1 with cosmetic powder. Then, put the separate disk 3 into the case body 1 to cover the cosmetic powder and put the puff 4 on the separate disk 3. Finally, cover the cover 2 on the case body 1.

Hereunder are the disadvantages of the conventional cosmetic powder case:

1. When carry the case, cosmetic powder is easy to escape from the case body 1 via the openings 3*a* of the separate disk 3.
2. The air will contact the cosmetic powder received in the case body 1 via the openings 3*a* of the separate disk 3. It makes the cosmetic powder to oxidize faster.
3. There only one type of cosmetic powder is accept to be received in the case body 1.

SUMMARY OF THE INVENTION

The primary object of the present invention is to provide a cosmetic powder case, which has no drawbacks as described above.

According to the objective of the present invention, a cosmetic powder case comprises a case body, which has a chamber and a lip wall at the open end of the chamber. The lip wall has a position slot at interior side thereof and an order slot at exterior side thereof. The order slot has a lock ring slot thereon. A main cover has covering slot at bottom side thereof. An interior cover has a piece body and a round cover body, which are formed as a unity. The interior cover secures to the main body by the cover body engaging to the covering slot. A separate disk has an axial hole at central, channel potions around the axial hole, each of which has openings thereon, and a lock sidewall at the edge thereof, which has position flange at exterior side and a ring slot at interior side. The ring slot has position blocks therein. A rotatable disk has an axial rod at bottom side thereof, channels around the axial hole, lock device, which are two parallel ribs, at exterior side thereof and a L-shaped lock flange extended from the edge thereof. The lock flange has a ring rib at distal end of interior side thereof, and a puff has a band thereon for facilitating user to grip. Thereof, first we put cosmetic powder into the case body, put the separate disk into the chamber of the case body with the position flange of the separate disk engaging to the position slot of the case body and the lock sidewall of the separate disk engaging to the lip wall of the case body to secure the separate disk on the case body, cover the rotatable disk on the separate disk with the axial rod of the rotatable disk receiving in the axial hole and the lock rib of the lock flange of the rotatable disk engaging to the lock ring slot of the order slot of the case body, such that the rotatable disk can rotates relative to the case body but cannot depart from the case body

DETAIL DESCRIPTION OF THE INVENTION

Figure 1:
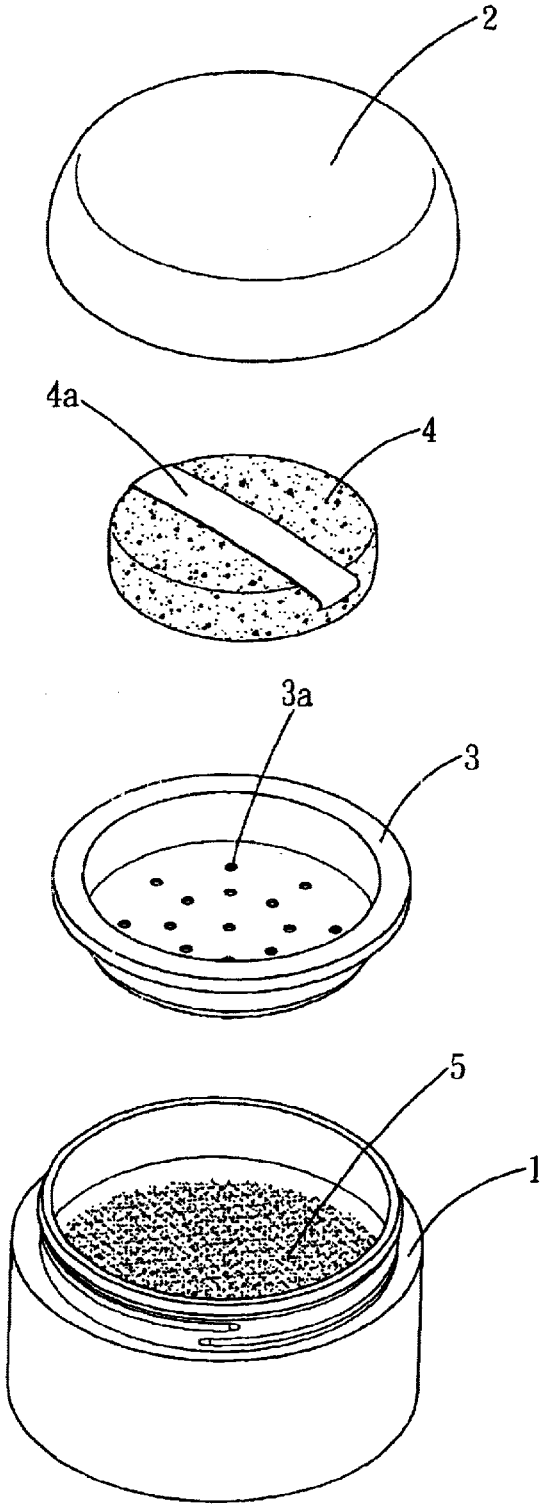
FIG. 1 PRIOR ART
FIG. 1 is an exploded view of a prior art.
Figure 2:
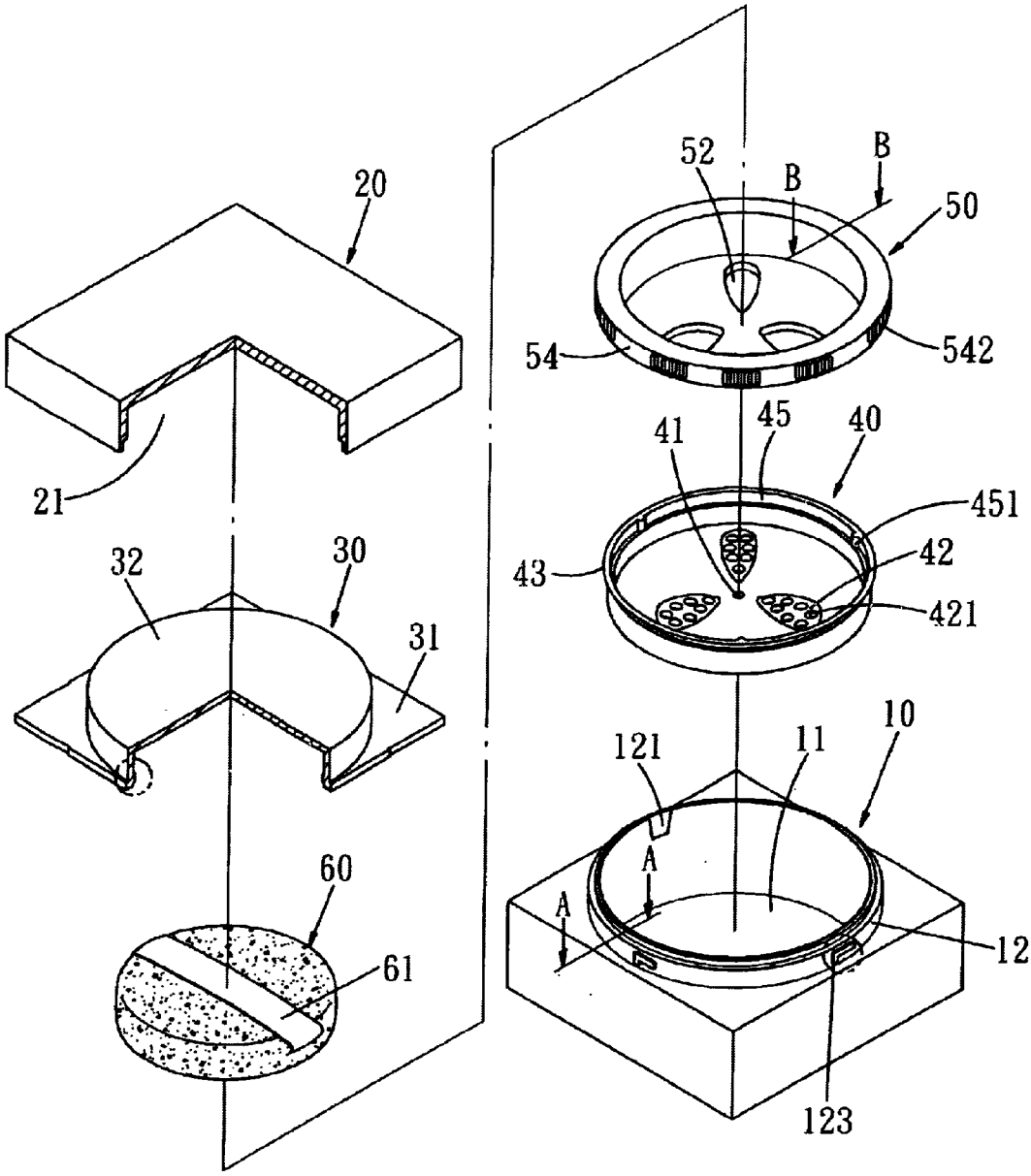
FIG. 2 is an exploded view of a prefer embodiment of the present invention.
Figure 3:
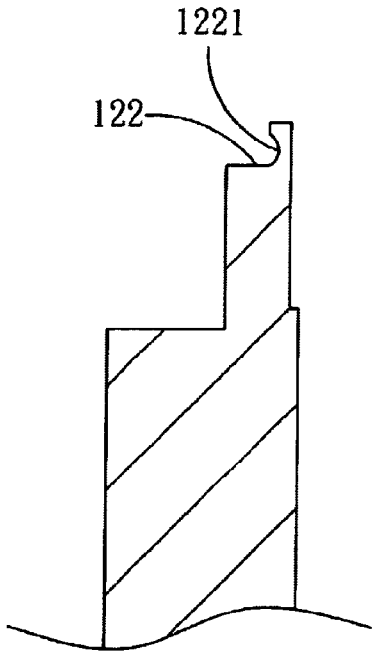
FIG. 3 is an exaggerated view of the portion a of the case body taken in FIG. 2.
Figure 4:
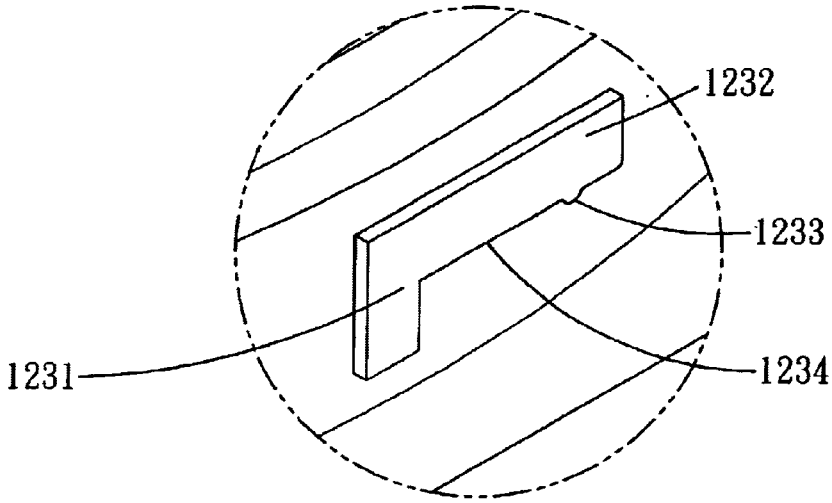
FIG. 4 is an exaggerated sectional view of the case body taken along the line A—A of FIG. 2.
Figure 5:
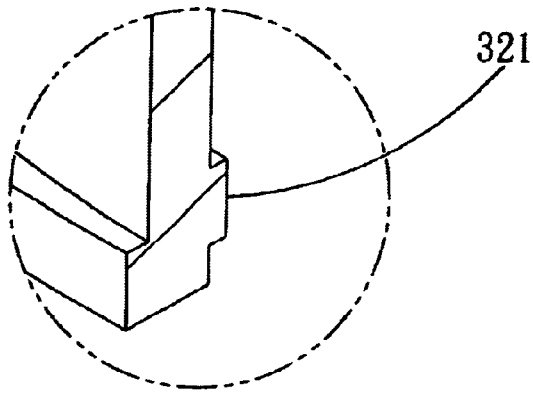
FIG. 5 is an exaggerated view of the portion b of the interior cover taken in FIG. 2.
Figure 6:
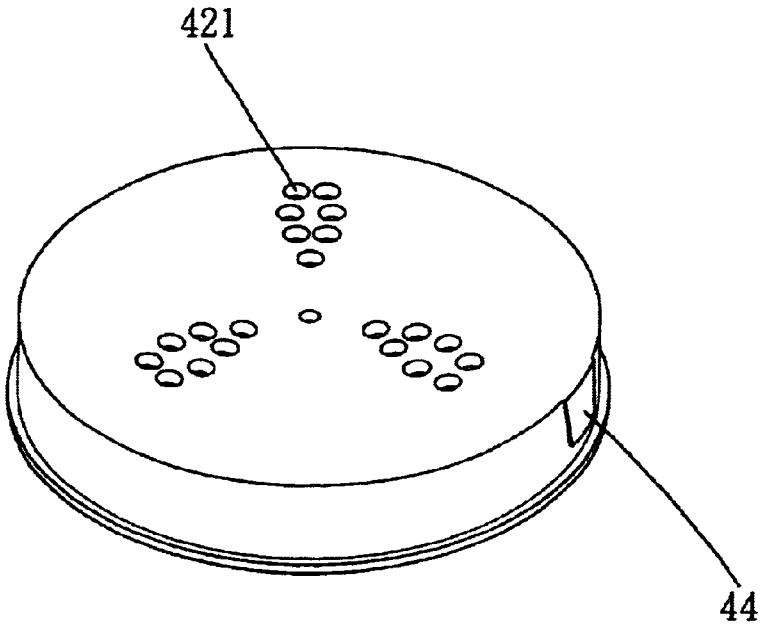
FIG. 6 is a reverse side view of the separate disk of the prefer embodiment of the present invention.
Figure 7:
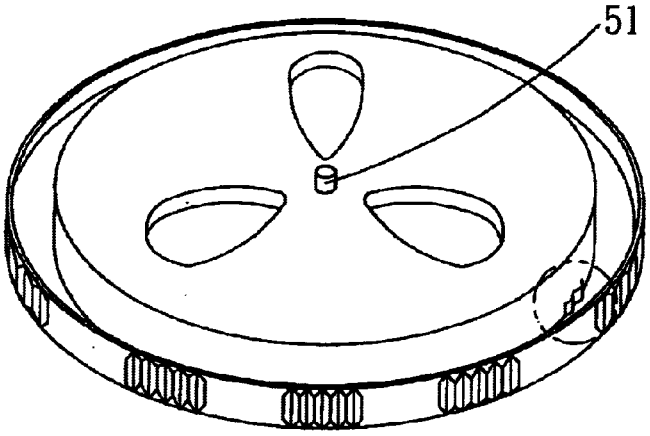
FIG. 7 is a reverse side and an exaggerated view of the rotatable disk of the prefer embodiment of the present invention.
Figure 7A:
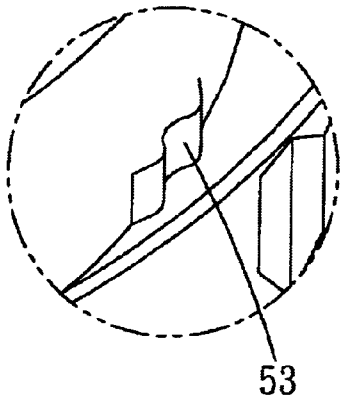
Figure 8:
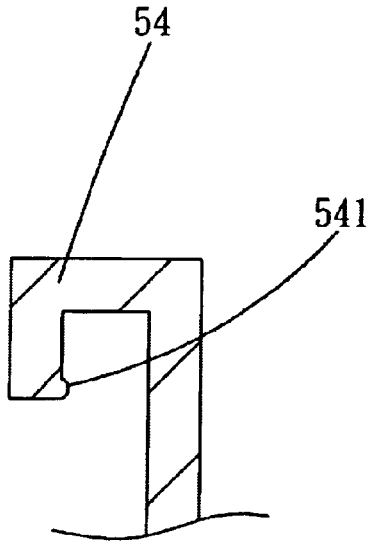
FIG. 8 is an exaggerated sectional view of the rotatable disk taken along the line B—B of FIG. 2.

Please refer to FIGS. From FIG. 2 to FIG. 8, the first prefer embodiment of the present invention provides a cosmetic powder case, which has a case body 10, a main cover 20, an interior cover 30, a separate disk 40, a rotatable disk 50 and a puff 60.

The case body 10 has a chamber 11 therein and a lip wall 12 at the open end of the chamber 11. The lip wall 12 has a position slot 121 at interior side thereof and an order slot 122 thereof around the exterior side. The order slot 122 has a lock ring slot 1221. The lip wall 12 has four lock pieces 123 at the exterior side thereof in equidistance. Each of the lock pieces 123 has an inclined track 1231 and a lock slot 1232.

The main cover 20 has a cover slot 21 at bottom side thereof.

The interior cover 30 has a rectangular piece body 31 and a round cover body 32 at central, which are formed as a unity. The cover body 32 has four round blocks 321 at the interior side thereof in equidistance.

The separate disk 40 has an axial hole 41 at central and three channel potions 42 around the axial hole 41. Each of the channel potions 42 has openings 421 thereon. The separate disk 40 further has a lock sidewall 43 at the edge thereof, which has a position flange 44 at distal end of exterior side thereof and a ring slot 45 at interior side thereof. The ring slot 45 has three position blocks 451.

The rotatable disk 50 has an axial rod 51 on a side thereof at central, three channels 52 around the rod 51, a lock device 53, which is two parallel ribs, at distal end thereof and a L-shaped lock flange 54 at the edge. The lock flange 54 has a ring rib 541 at distal end of interior side thereof and grip ribs 542 at outer surface thereof.

The puff 60 has a band 61 thereon for facilitating user to grip.

Figure 9:
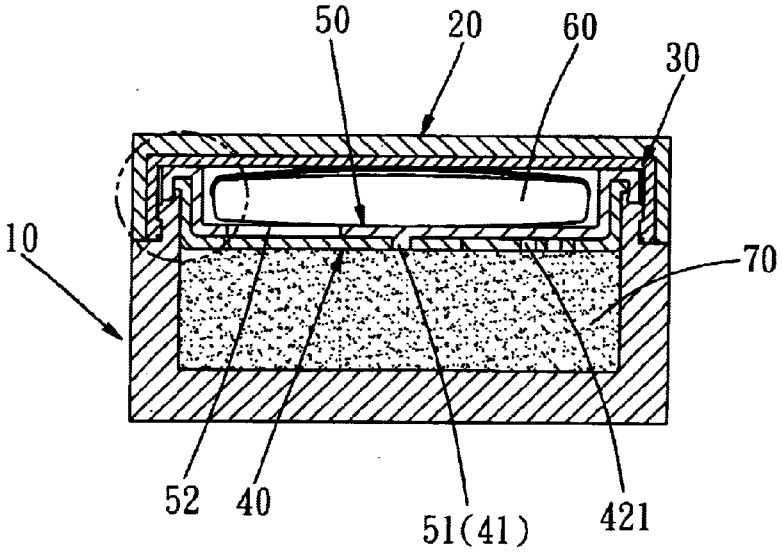
FIG. 9 is a sectional and an exaggerated view of the prefer embodiment of the present invention in combination.
Figure 9A:
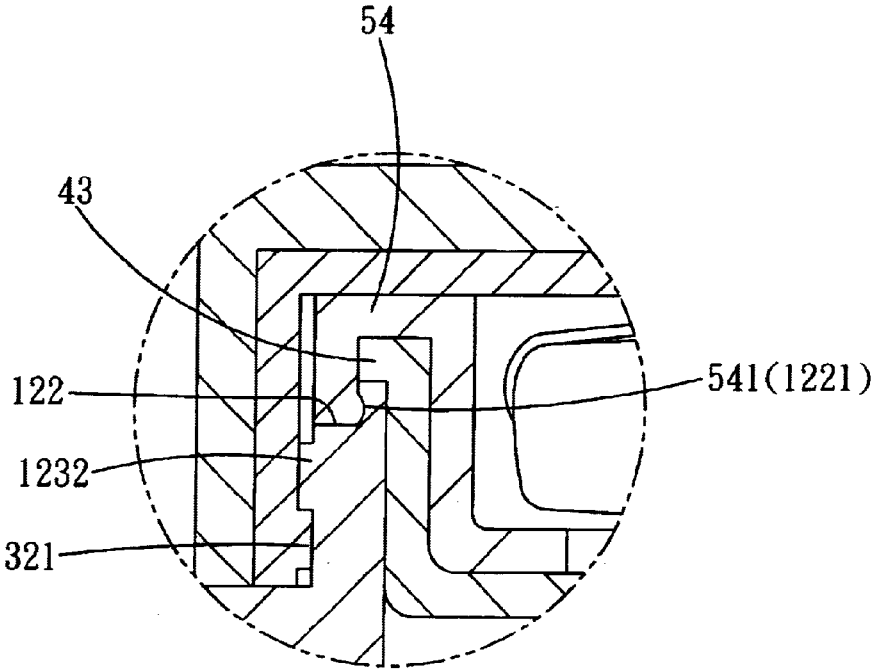
Figure 10:
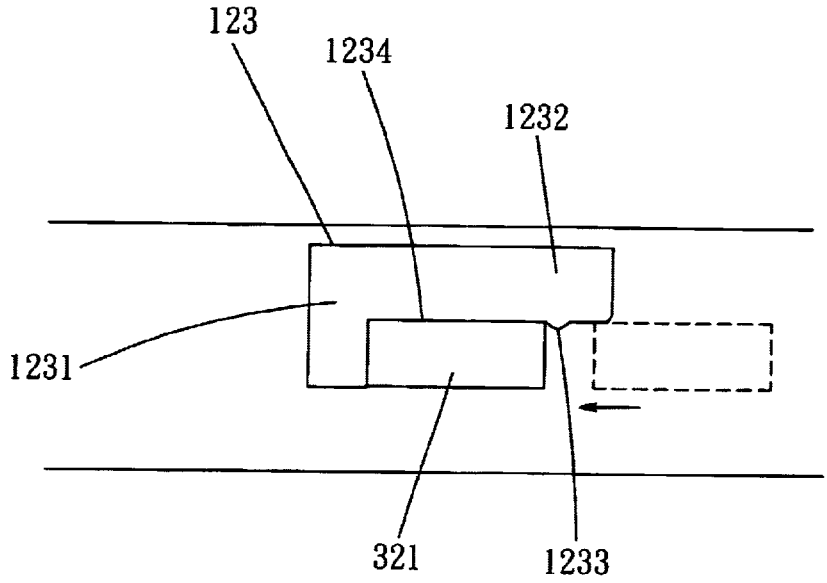
FIG. 10 is a sectional view of the prefer embodiment of the present invention, showing the interior cover locking the case body.

In assembling, please refer to FIG. 9 and FIG. 10, first we put cosmetic powder 70 into the case body 10. Then, put the separate disk 40 into the chamber 11 of the case body 10 with the position flange 44 of the separate disk 40 engaging to the position slot 121 of the case body 10 and the lock sidewall 43 of the separate disk 40 engaging to the lip wall 12 of the case body 10 to secure the separate disk 40 on the case body 10. Cover the rotatable disk 50 on the separate disk 40 with the axial rod 51 of the rotatable disk 50 receiving in the axial hole-41 and the lock rib 541 of the lock flange 54 of-the rotatable disk 50 engaging to the lock ring slot 1221 of the order slot 122 of the case body 10, such that the rotatable disk 50 can rotates relative to the case body 10 but cannot depart from the case body 10. After that, we put the puff 60 into the rotatable disk 50. The cover body 32 of the interior cover 30 engages to the cover slot 21 of the main cover 20 to secure the interior cover 30 to the main cover. 20. Finally, mesh the main cover 20 and the interior cover 30 with the case body 10 for the round blocks 321 of the interior cover 30 sliding along the incline tracks 1231 of the case body 10 to receive in the lock slots 1232 for tightly securing them together.

Figure 11:
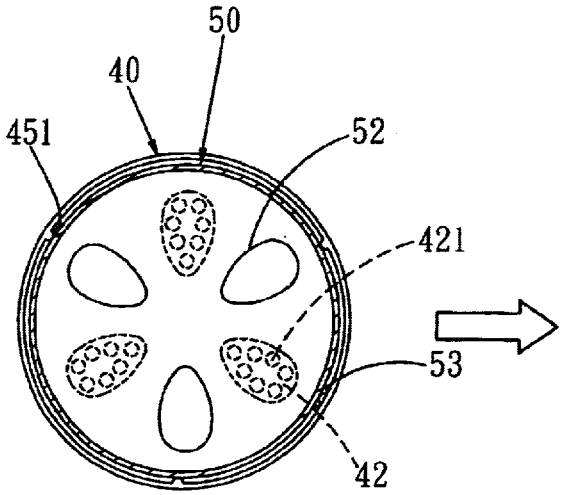
FIG. 11 is a perspective view of the prefer embodiment of the present invention, showing the rotatable disk being turned.
Figure 11A:
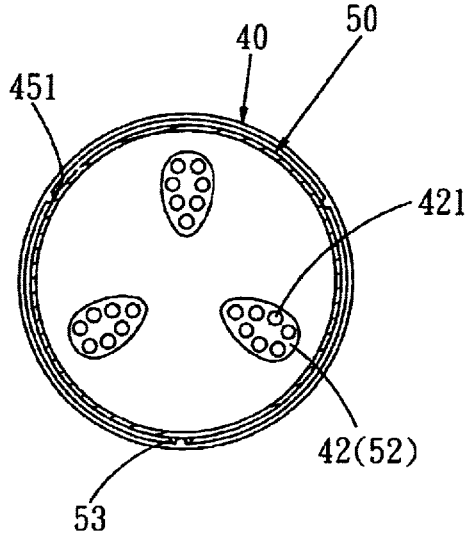
Figure 12:
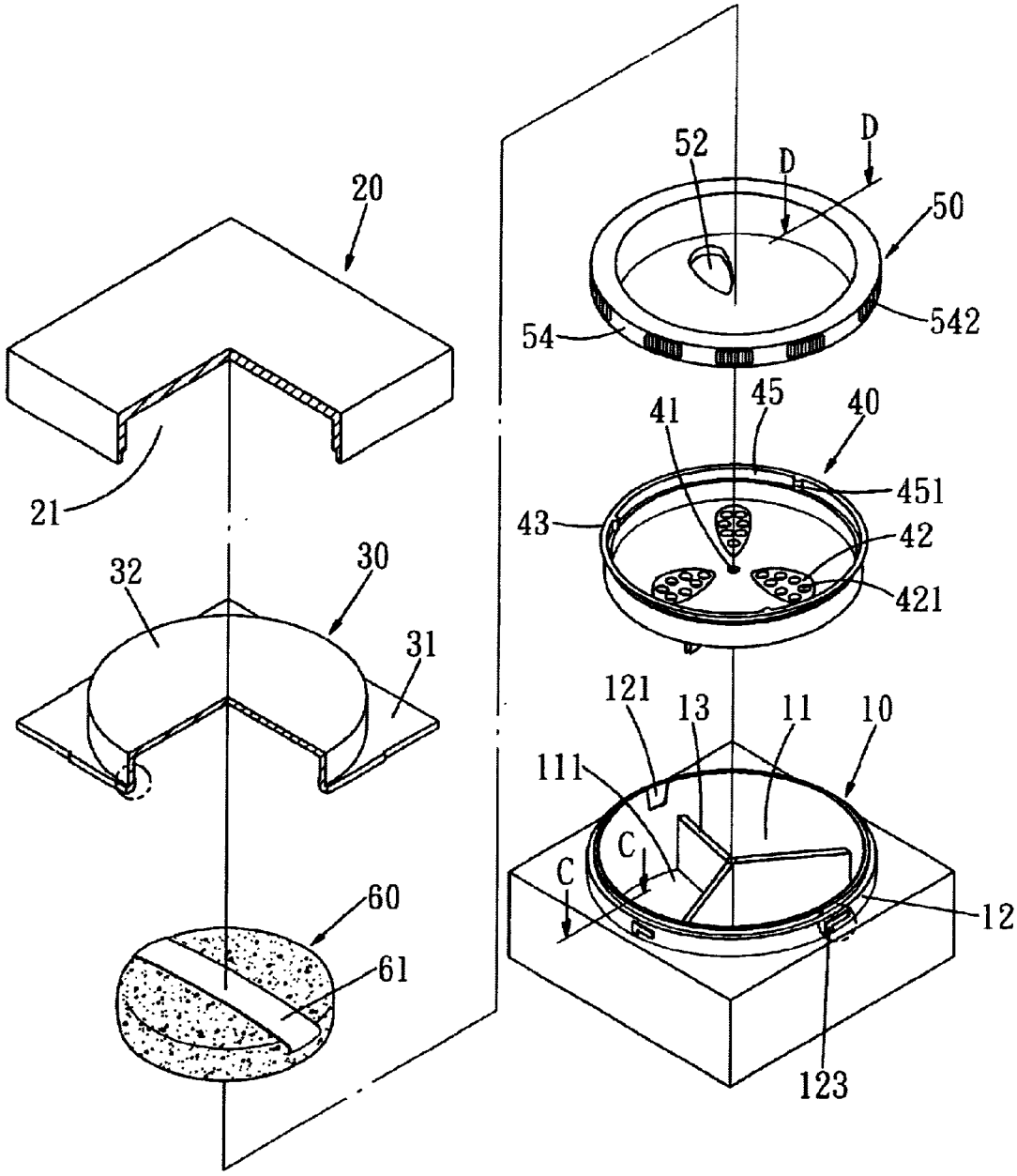
FIG. 12 is an exploded view of another type of the prefer embodiment of the present invention.
Figure 13:
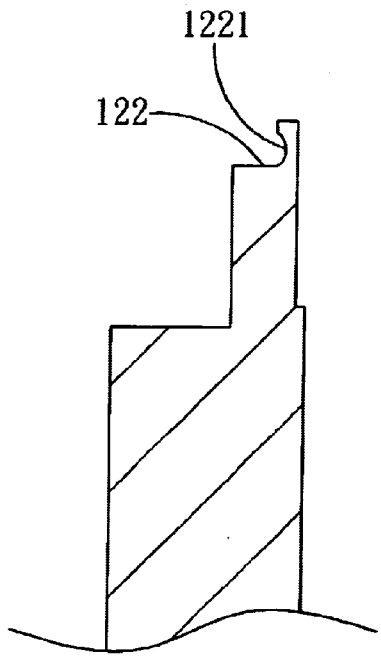
FIG. 13 is an exaggerated view of the portion c of the case body taken in FIG. 12.
Figure 14:
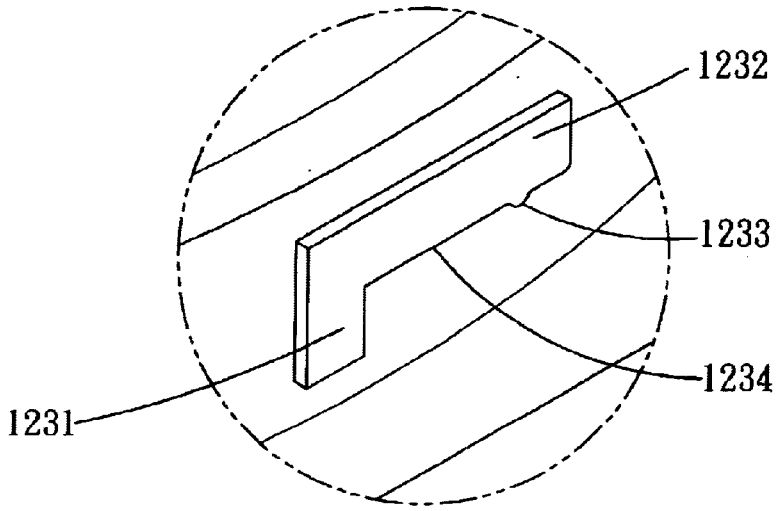
FIG. 14 is an exaggerated sectional view of the case body taken along the line C—C of FIG. 13.
Figure 15:
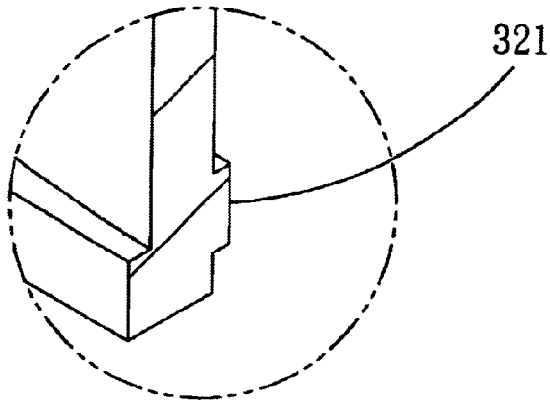
FIG. 15 is an exaggerated view of the portion d of the interior cover taken in FIG. 12.
Figure 16:
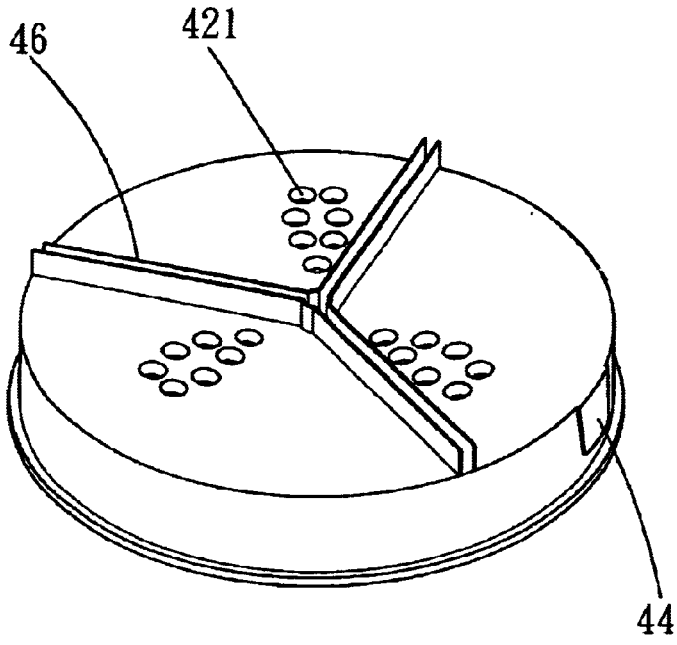
FIG. 16 is a reverse side view of the separate disk of another type of the prefer embodiment of the present invention.
Figure 17:
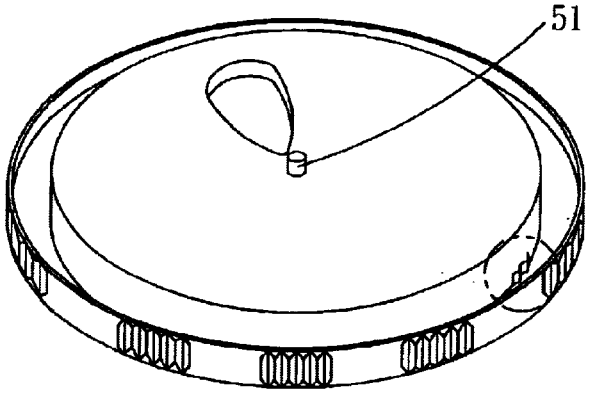
FIG. 17 is a reverse side and an exaggerated view of the rotatable disk of another type of the prefer embodiment of the present invention.
Figure 17A:
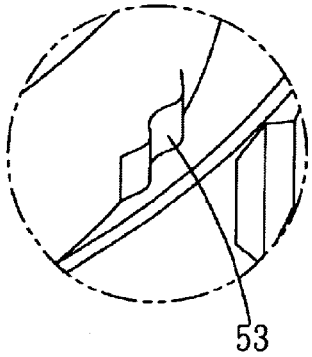
Figure 18:
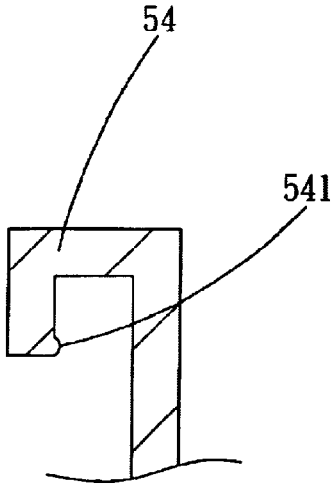
FIG. 18 is an exaggerated sectional view of the rotatable disk taken along the line D—D of FIG. 12.

Please refer to FIG. 11, in use, user turns loose the main cover 20 first, then turns the rotatable disk 50 for the lock device 53 thereof engaging to one of the position blocks 451 of the ring slot 45 of the separate disk 40. Whereby, the channels 53 of the rotatable disk 50 will correspond to the openings 421 of the channel potions 42 of the separate disk 40 to make the puff 60 can get the powder 70 via the channels 53 and the openings 421. After use, user turns the rotatable disk 50 to make the rotatable disk 50 no longer corresponding to the openings 421 of the channel potions 42 of the separate disk 40. Thus, rotatable disk 50 will seal the chamber 11 of the case body 10 to make the powder 70 not escaping from the chamber 11 of the case body 10.

FIG. 12 to FIG. 18 shows a cosmetic powder case of another type, which is similar to the cosmetic powder case as described above. Except that, the chamber 11 has a Y-shaped separate board 13 therein to make the chamber 11 having three sub-chambers 111 therein for receiving three different types of cosmetic powders therein respectively and the separate disk 40 has a Y-shaped engage rib 46 corresponding to the Y-shaped separate board 13.

Figure 19:
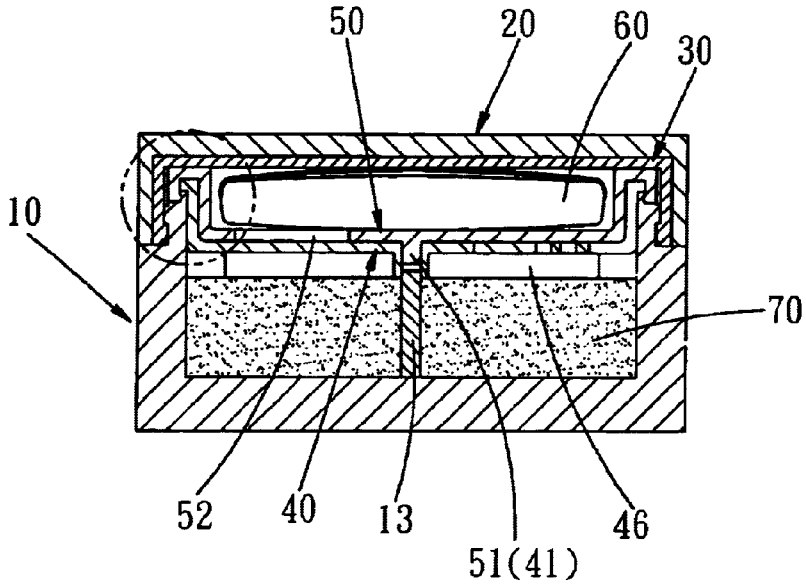
FIG. 19 is a sectional and an exaggerated view of another type of the prefer embodiment of the present invention in combination.
Figure 19A:
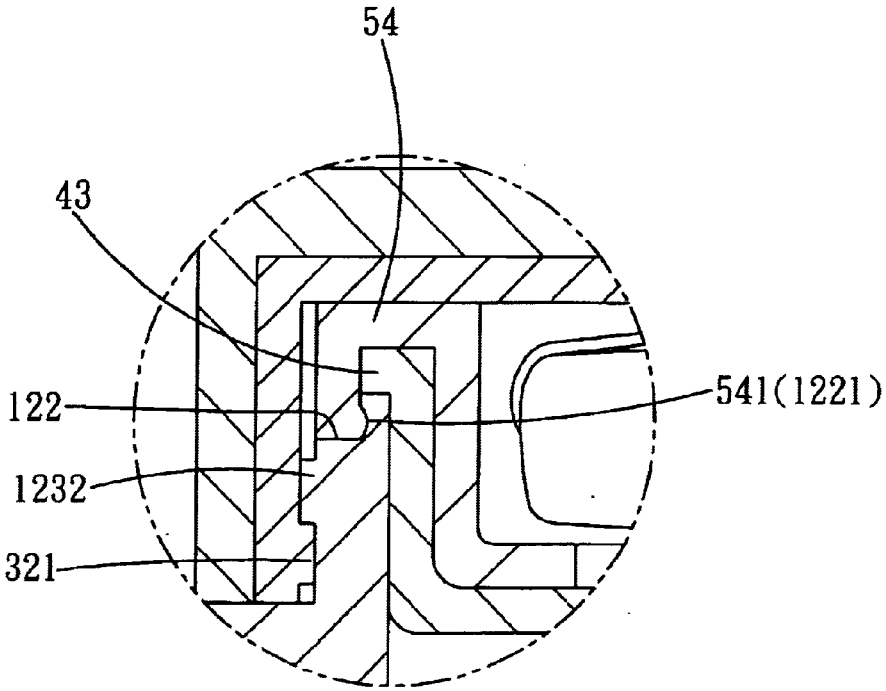

In assembling, please refer to FIG. 19, first we put cosmetic powders 70 into the sub-chambers 111 of the case body 10. Then, put the separate disk 40 into the chamber 11 of the case body 10 with the position flange 44 of the separate disk 40 engaging to the position slot 121 of the case body 10 and the lock sidewall 43 of the separate disk 40 engaging to the lip wall 12 of the case body 10 to secure the separate disk 40 on the case body 10. In the meantime, the Y-shapes engage rib 46 of the separate disk 40 will engage to the Y-shaped separate board 13 of the case body 10. Cover the rotatable disk 50 on the separate disk 40 with the axial rod 51 of the rotatable disk 50 received in the axial hole 41 and the lock rib 541 of the lock flange 54 of the rotatable disk 50 engaging; to the lock ring slot 1221 of the order slot 122 of the case body 10, such that the rotatable disk 50 can rotates relative to the case body 10 but cannot depart from the case body 10. After that, we put the puff 60 into the rotatable disk 50. The cover body 32 of the interior cover 30 engages to the cover slot 21 of the main cover 20 to secure the interior cover 30 to the main cover 20. Finally, mesh the main cover 20 and the interior cover 30 with the case body 10 for the round blocks 321 of the interior cover 30 sliding along the incline tracks 1231 of the case body 10 to receive in the lock slots 1232 respectively for tightly securing them together.

Figure 20:
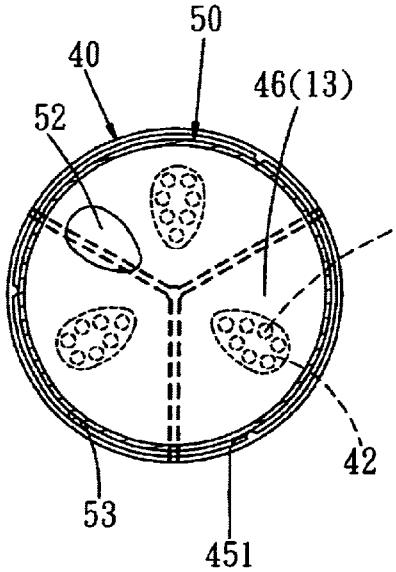
FIG. 20 is a perspective view of another type of the prefer embodiment of the present invention, showing the rotatable disk being turned.
Figure 20A:
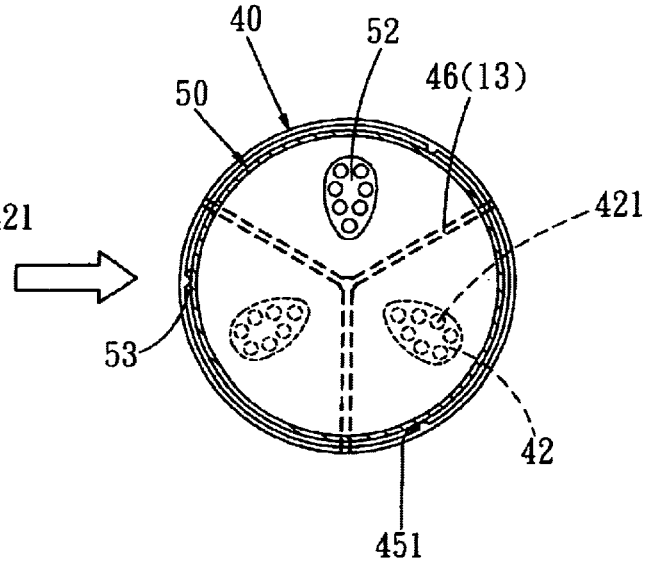

Please refer to FIG. 20, in use, user turns loose the main cover 20 first, then turns the rotatable disk 50 for the lock device 53 thereof engaging to one of the position blocks 451 of the ring slot 45 of the separate disk 40. Whereby, the channels 53 of the rotatable disk 50 will correspond to the openings 421 of the channel potions 42 of the separate disk 40 to make the puff 60 can get the powder 70 via the channels 53 and the openings 421. After use, user turns the rotatable disk 50 to make the rotatable disk 50 no longer corresponding to the openings 421 of the channel potions 42 of the separate disk 40. Thus, rotatable disk 50 will seal the chamber 11 of the case body 10 to make the powder 70 not escaping from the chamber 11 of the case body 10.

Hereunder are the advantages of the present invention:

1. The chamber 11 of the case body 10 is sealed by the rotatable disk 50 being turned to cover the openings 421 of the separate disk 40. The powder 70 received in the case of the present invention will not escape when user carry the case.
2. In storage, the powder 70 received in the case of the present invention is still sealed in the chamber 11 of the case body 10 to avoid the powder 70 contacting with the air. That will make the powder 70 can be kept longer.
3. I provide the separate board 13 in the chamber 11 of the case body 10 to make the case of the present invention can store different types of powders for facilitating user to use.

What is claimed is:

1. A cosmetic powder case, comprising:

a case body having a chamber and a lip wall at an opening end of said chamber;

said lip wall having a position slot at an interior side thereof and an order slot at an exterior side thereof;

said order slot having a lock ring slot thereon;

a main cover having a cover slot at a bottom side thereof;

an interior cover secured in said main cover and having a round cover body received in said cover slot of said main cover;

a separate disk mounted in said chamber of said case body and having an axial hole, a plurality of channel portions located around said axial hole and a lock sidewall at an edge thereof;

each of said channel portions having plurality of openings;

said lock sidewall of said separate disk being engaged with said lip wall of said case body to secure said separate disk on said case body;

said lock sidewall of said separate disk having a position flange at an exterior side thereof and a ring slot at an interior side thereof;

said position flange of said separate disk being engaged in said position slot of said case body;

said ring slot having a plurality of position blocks;

a rotatable disk mounted on said separate disk and having an axial rod received in said axial hole of said separate disk, a plurality of channels located around said axial rod, a lock device at an exterior side thereof and a an L-shaped lock flange extended from an edge thereof;

said lock flange of said rotatable disk having a lock rib at a distal end of an interior side thereof;

said lock rib of said lock flange of said rotatable disk being engaged in said lock ring slot of said order slot of said case body, such that said rotatable disk can rotate relative to said case body and cannot detach from said case body; and a puff mounted in said rotatable disk.

2. The cosmetic powder case as defined in claim 1, wherein said case body has lock pieces disposed at the exterior side of said lip wall, each of which has an inclined track and a lock slot, and said interior cover has round blocks at interior side thereof, such that said interior cover can mesh with said case body by said round blocks sliding along said inclined tracks to receive in the lock slots respectively for tightly securing them together.

3. A cosmetic powder case, comprising:

a case body having a chamber and a lip wall at an opening end of said chamber;

said lip wall having a position slot at an interior side thereof and an order slot at an exterior side thereof;

said order slot having a lock ring slot thereon;

a separate board disposed in said chamber for dividing said chamber into a plurality of sub-chambers;

a main cover having a cover slot at a bottom side thereof;

an interior cover secured in said main cover and having a round cover body received in said cover slot of said main cover;

a separate disk mounted in said chamber of said case body and having an axial hole, a plurality of channel portions located around said axial hole and a lock sidewall at an edge thereof;

each of said channel portions having plurality of openings;

said lock sidewall of said separate disk being engaged with said lip wall of said case body to secure said separate disk on said case body;

said lock sidewall of said separate disk having a position flange at an exterior side thereof and a ring slot at an interior side thereof;

said position flange of said separate disk being engaged in said position slot of said case body;

said ring slot having a plurality of position blocks;

a rotatable disk mounted on said separate disk and having an axial rod received in said axial hole of said separate disk, a plurality of channels located around said axial rod, a lock device at an exterior side thereof and an L-shaped lock flange extended from an edge thereof;

said lock flange of said rotatable disk having a lock rib at a distal end of an interior side thereof;

said lock rib of said lock flange of said rotatable disk being engaged in said lock ring slot of said order slot of said case body, such that said rotatable disk can rotate relative to said case body and cannot detach from said case body; and a puff mounted in said rotatable disk.

4. The cosmetic powder case as defined in claim 3, wherein said case body has lock pieces disposed at the exterior side of said lip wall, each of which has an inclined track and a lock slot, and said interior cover has round blocks at interior side thereof, such that said interior cover can mesh with said case body by said round blocks sliding along said inclined tracks to receive in the lock slots respectively for tightly securing them together.

* * * * *